US007915996B2

(12) United States Patent
Goto et al.

(10) Patent No.: US 7,915,996 B2
(45) **Date of Patent: *Mar. 29, 2011**

(54) ELECTRONIC COMPONENT AND METHOD FOR PRODUCING THE SAME

(75) Inventors: Seiji Goto, Yasu (JP); Masahiro Kimura, Ogaki (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 0 days.

This patent is subject to a terminal disclaimer.

(21) Appl. No.: 12/496,699

(22) Filed: Jul. 2, 2009

(65) Prior Publication Data

US 2009/0261942 A1 Oct. 22, 2009

Related U.S. Application Data

(63) Continuation of application No. PCT/JP2007/067379, filed on Sep. 6, 2007.

(30) Foreign Application Priority Data

Jan. 5, 2007 (JP) ..... 2007-000822

(51) Int. Cl.
*H01C 1/012* (2006.01)

(52) U.S. Cl. ..... 338/307; 338/213; 338/333; 338/195; 29/620; 29/610.1

(58) Field of Classification Search ..... 338/195, 338/307, 308, 309, 213, 333; 29/610.1, 620
See application file for complete search history.

(56) References Cited

U.S. PATENT DOCUMENTS

| | | | | |
|---|---|---|---|---|
| 6,084,502 | A * | 7/2000 | Ariga et al. | 338/195 |
| 7,595,716 | B2 | 9/2009 | Goto et al. | |

FOREIGN PATENT DOCUMENTS

| | | | |
|---|---|---|---|
| JP | 59-215763 | A | 12/1984 |
| JP | 60-030101 | A | 2/1985 |
| JP | 06-310052 | A | 11/1994 |
| JP | 10-189305 | A | 7/1998 |
| JP | 2004-165201 | A | 6/2004 |
| WO | 2007/088948 | A1 | 8/2007 |

OTHER PUBLICATIONS

Official Communication issued in International Patent Application No. PCT/JP2007/067379, mailed on Dec. 4, 2007.

* cited by examiner

*Primary Examiner* — Kyung Lee
(74) *Attorney, Agent, or Firm* — Keating & Bennett, LLP

(57) ABSTRACT

An electronic component and a method for producing the electronic component achieve efficient production of resistive elements with various resistances. The electronic component includes a pair of terminals opposite each other and a resistive element disposed between the pair of terminals. The resistive element includes a plurality of dots arranged so as to overlap each other in a reference arrangement pattern excluding a portion of the arrangement pattern. To produce the electronic component, an electronic component is prototyped in advance and includes a resistive element in which the dots are arranged in the entire reference arrangement pattern between the pair of terminals. The prototyped resistive element is then partially removed so as to attain a desired resistance. An electronic component is then produced in which the dots are arranged in the reference arrangement pattern with a portion of the arrangement pattern excluded on the basis of the shape of the partially removed resistive element.

5 Claims, 4 Drawing Sheets

ELECTRONIC COMPONENT AND METHOD FOR PRODUCING THE SAME

BACKGROUND OF THE INVENTION

1. Field of the Invention

The present invention relates to electronic components and methods for producing electronic components, and specifically to electronic components including resistive elements and methods for producing such electronic components.

2. Description of the Related Art

Screen printing and inkjetting, for example, are known as methods for forming resistive elements, such as resistive films, with desired resistance in, for example, resistors.

Japanese Unexamined Patent Application Publication No. 60-30101, for example, discloses a method of forming dot-like first resistive portions and varying areas at varying intervals on a surface of a substrate in a substantially striped pattern by screen printing and then forming over the first resistive portions a continuous layered second resistive portion whose electrical resistance differs from that of the first resistive portion.

Japanese Unexamined Patent Application Publication No. 10-189305, on the other hand, discloses a method of forming a resistor by depositing a single type of resistive ink on an unfired ceramic sheet by inkjetting.

However, if resistive portions are formed by screen printing as in Japanese Unexamined Patent Application Publication No. 60-30101, screens must be replaced for different resistances. This involves a considerable screen production cost for each resistance and a long period of time for screen production.

In addition, if two or more types of conductive pastes are applied by screen printing, they cannot be simultaneously applied; a drying step and a screen replacement step are required for application of each type of conductive paste. In the application of the second and subsequent conductive pastes, the screens used must be located with high accuracy at the position where the previously applied conductive pastes have been applied. In addition, the second and subsequent conductive pastes may be unsuccessfully put into gaps between the previously applied conductive pastes by screen printing, thus leaving voids. It is therefore difficult to simplify the process.

If a resistor is formed using a single type of resistive ink as in Japanese Unexamined Patent Application Publication No. 10-189305, for example, formation of resistors with the same size and shape but different resistances requires resistive inks with different compositions corresponding to those resistances to be prepared in advance. It is therefore difficult to support high-mix, low-volume production.

SUMMARY OF THE INVENTION

In light of such circumstances, preferred embodiments of the present invention provide an electronic component and a method for producing the electronic component that achieve efficient production of electronic components including resistive elements with various resistances.

An electronic component according to a preferred embodiment of the present invention includes a pair of terminals opposite each other and a resistive element disposed between the pair of terminals. The resistive element includes a plurality of dots arranged so as to overlap each other in a reference arrangement pattern excluding a portion of the arrangement pattern.

For the above configuration, an electronic component is prototyped in advance and includes a resistive element in which dots are arranged in an entire reference arrangement pattern between a pair of terminals. The prototyped resistive element is then partially removed so as to attain a desired resistance. An electronic component is then produced in which dots are arranged in the reference arrangement pattern with a portion of the arrangement pattern excluded on the basis of the shape of the partially removed resistive element. This allows an electronic component including a resistive element with a desired resistance to be easily provided.

Preferably, the resistive element includes a plurality of layers of the dots, and the number of layers of the dots is larger in a region farther away from edges of the resistive element.

In this case, a stress occurring in the substrate around the edges of the resistive element can be alleviated. This prevents, for example, a crack in the substrate around the edges of the resistive element during firing. In addition, the adhesion strength between the substrate and the resistive element can be increased.

To solve the above problems, additionally, another preferred embodiment of the present invention provides a method, arranged as follows, for producing an electronic component.

The method for producing an electronic component according to a preferred embodiment of the present invention preferably includes (1) a first step of prototyping an electronic component including a resistive element by arranging dots of a resistive ink containing a constituent that is to be the resistive element in an entire reference arrangement pattern by inkjetting; (2) a second step of partially removing the resistive element of the prototyped electronic component while measuring the resistance of the resistive element; (3) a third step of determining a portion to be excluded from the arrangement pattern on the basis of the shape of the partially removed resistive element; and (4) a fourth step of manufacturing electronic components by arranging the dots of the resistive ink in the arrangement pattern excluding the determined portion.

According to the above method, trimming is performed only on the resistive element of the prototyped electronic component, and no trimming is required for resistive elements of the electronic components being manufactured.

To solve the above problems, additionally, a further preferred embodiment of the present invention provides a method, arranged as follows, for producing an electronic component.

The method for producing an electronic component according to the further preferred embodiment of the present invention includes (1) a first step of prototyping an electronic component including a resistive element by arranging dots of a resistive ink containing a constituent that is to be the resistive element in an entire reference arrangement pattern by inkjetting; (2) a second step of measuring the resistance of the resistive element of the prototyped electronic component; (3) a third step of determining the intervals of the arrangement pattern on the basis of the resistance of the resistive element; and (4) a fourth step of manufacturing electronic components by arranging the dots of the resistive ink at the determined intervals in the entire arrangement pattern.

According to the above method, resistance measurement is performed only on the prototyped electronic component, and no change of material, for example, is required. Thus, an electronic component with any resistance can be easily produced.

To solve the above problems, additionally, another preferred embodiment of the present invention provides a method, arranged as follows, for producing an electronic component.

The method for producing an electronic component according to another preferred embodiment of the present invention includes (1) a first step of prototyping an electronic component including a resistive element by arranging dots of a resistive ink containing a constituent that is to be the resistive element in an entire reference arrangement pattern by inkjetting; (2) a second step of measuring the resistance of the resistive element of the prototyped electronic component; (3) a third step of determining the size of the dots of the resistive ink on the basis of the measured resistance of the resistive element; and (4) a fourth step of manufacturing electronic components by arranging the dots of the resistive ink with the determined size of the dots in the entire arrangement pattern.

According to the above method, resistance measurement is performed only on the prototyped electronic component, and no change of material, for example, is required. Thus, an electronic component with any resistance can be easily produced. In addition, the size of the dots can be easily adjusted because it can be changed depending on, for example, the voltage applied for inkjet ejection.

Various preferred embodiments of the present invention achieve efficient production of electronic components including resistive elements with various resistances.

Other features, elements, steps, characteristics and advantages of the present invention will become more apparent from the following detailed description of preferred embodiments of the present invention with reference to the attached drawings.

DETAILED DESCRIPTION OF THE PREFERRED EMBODIMENTS

Preferred embodiments of the present invention will now be described with reference to FIGS. 1 to 4C.

Figure 1:
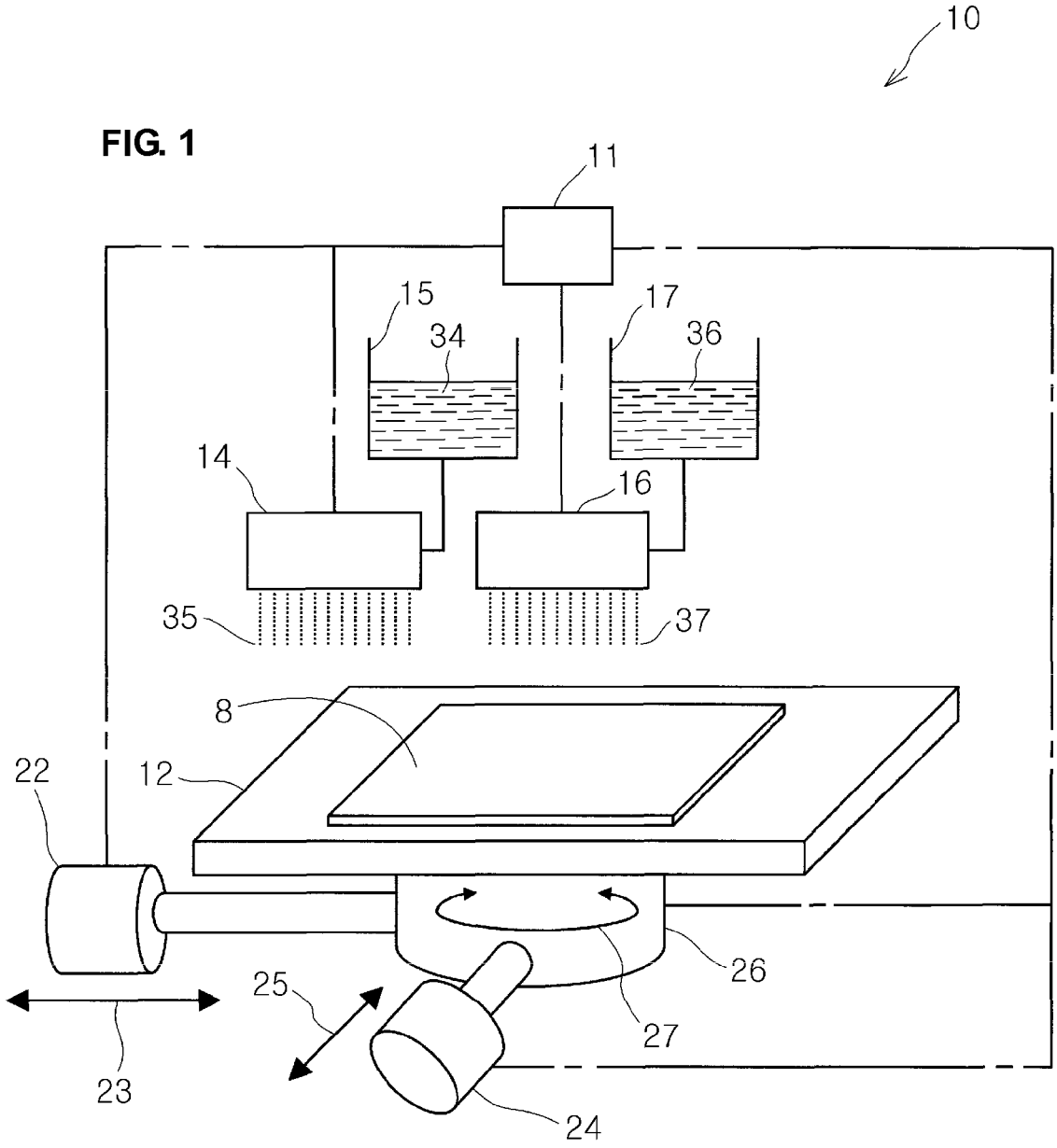
FIG. 1 is an overall diagram of an inkjet printer.

First, an inkjet printer 10 used for printing a pattern that is to be a resistive film (resistive element) will be described with reference to the schematic diagram in FIG. 1.

The inkjet printer 10 mainly includes a movable table 12 on which a substrate 8 is placed, a plurality of (for example, two) inkjet heads 14 and 16, and a control unit 11 responsible for overall system control.

The movable table 12 is actuated by a motor 22 in the X direction indicated by reference numeral 23, is actuated by a motor 24 in the Y direction indicated by reference numeral 25, and is actuated by a motor 26 in the θ direction indicated by reference numeral 27 (about the Z axis perpendicular to the X and Y axes). The motors 22, 24, and 26 are driven under the control of the control unit 11. The movable table 12 may also be moved in directions other than the X, Y, and θ directions, or may be moved only in one or two of the X, Y, and θ directions. The movable table 12 may have a vacuum suction hole for attracting the substrate 8 and a heater for raising and maintaining the temperature of the substrate 8 as needed.

The inkjet heads 14 and 16 are disposed at fixed positions above the movable table 12. The inkjet heads 14 and 16 are supplied with resistive inks 34 and 36 with different compositions from tanks 15 and 17, respectively. The inkjet heads 14 and 16 have one or more minute holes through which ink droplets 35 and 37, that is, fine particles of the resistive inks 34 and 36, are ejected toward the movable table 12. The control unit 11 controls the inkjet heads 14 and 16 to change the size (amount of ink droplet) and number of ink droplets 35 and 37 ejected.

The resistive inks 34 and 36 contain resistive materials such as ruthenium oxide, glass, carbon, and metal particles, for example. The substrate 8 placed on the movable table 12 is a work such as a substrate or a ceramic green sheet for production of electronic components.

The control unit 11 used preferably includes, for example, a personal computer. The control unit 11 drives the inkjet heads 14 and 16 in synchronization with the movement of the movable table 12 to cause them to eject the ink droplets 35 and 37 on the basis of parameters input from, for example, a keyboard (not shown) according to a predetermined program. Thus, a predetermined pattern is printed with the resistive inks 34 and 36 on the substrate 8 placed on the movable table 12.

Preferably, inkjet heads 14 and 16 having a plurality of ink ejection holes arranged in a row through which the ink droplets 35 and 37 are ejected are arranged so that the rows of the ink ejection holes are parallel or substantially parallel to each other. The movable table 12 is actuated in a direction perpendicular to or inclined with respect to the rows of the ink ejection holes of the inkjet heads 14 and 16.

For example, inkjet heads 14 and 16 that eject the ink droplets 35 and 37 at different pitches are preferably used. Alternatively, inkjet heads 14 and 16 that eject the ink droplets 35 and 37 at the same pitch are used to apply resistive inks 34 and 36 with different characteristics in layers. Alternatively, inkjet heads 14 and 16 that eject the ink droplets 35 and 37 at the same pitch are used to apply resistive inks 34 and 36 with the same characteristics substantially at the same time, thereby efficiently forming a pattern that is to be a resistive element.

Instead of moving the substrate 8 with the inkjet heads 14 and 16 disposed at the fixed positions, the inkjet heads 14 and 16 may be moved with the substrate 8 fixed, or both the substrate 8 and the inkjet heads 14 and 16 may be moved.

After the inkjet printer 10 is used to print a pattern that is to be as a resistive film with one or more types of resistive inks, the pattern is dried and fired to form a resistive film.

Next, patterns in which ink droplets, that is, dots, are arranged will be described with reference to FIGS. 2A to 4C.

Figure 2C:
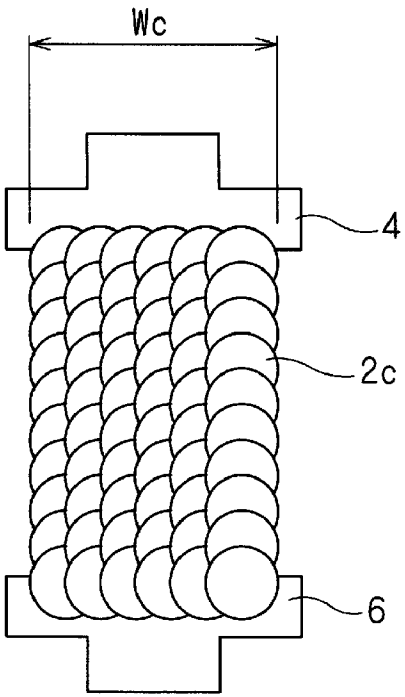
FIGS. 2A-2C are sets of schematic diagrams showing dot arrangements.
Figure 2B:
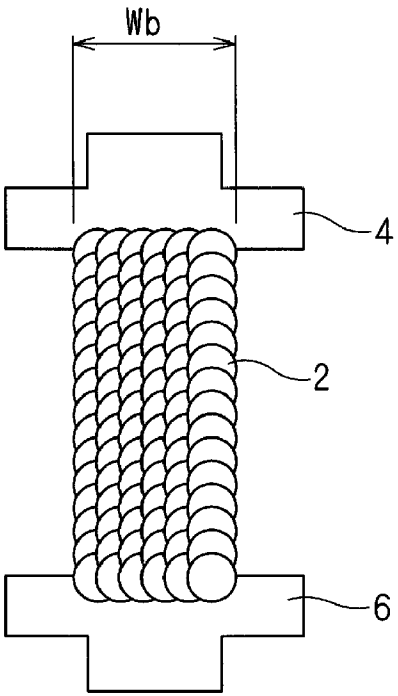
Figure 2A:
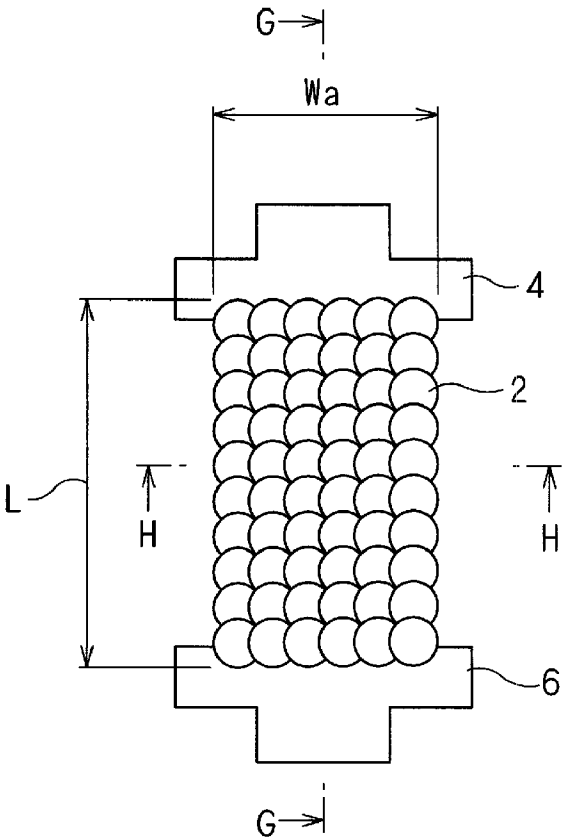

As schematically shown in the plan views in FIGS. 2A-2C, dots 2 or 2*c* of a single type of resistive ink are arranged between terminals 4 and 6 formed in advance on the substrate 8 (see FIG. 1) so that the set of dots 2 or 2*c* forms a portion that is to be a resistive film.

As shown in FIG. 2A, for example, a plurality of (in the figure, 6×10) dots 2 of the resistive ink are arranged between the terminals 4 and 6 in a rectangular grid arrangement pattern so as to overlap each other.

As shown in FIG. 2B, the pitch of the arrangement pattern in which the dots 2 of the resistive ink are arranged can be changed either in the vertical direction or in the horizontal direction. For example, the ink ejection holes of the inkjet head are used at intervals of one hole rather than at intervals of two holes, and the amount of shift of the movable table in the direction perpendicular to the row of the ink ejection holes of the inkjet head is changed.

It is also possible to change the pitch only in the X direction or in the Y direction. In this case, for example, only the pitch of the ink ejection holes used of the inkjet head is changed, or only the amount of shift of the movable table in the direction perpendicular to the row of the ink ejection holes of the inkjet head is changed.

As shown in FIG. 2C, the size of the dots 2*c* of the resistive ink can also be changed. In this case, for example, the size of the ink droplets ejected is changed by changing the voltage applied to a drive actuator of the inkjet head. Alternatively, the inkjet head used is switched to one that ejects different amounts of ink droplets.

Figure 3A:
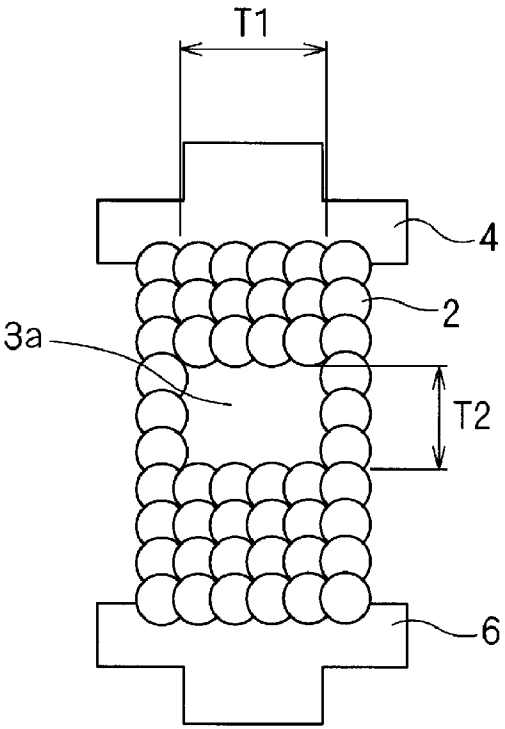
FIGS. 3A-3C are schematic diagrams showing dot arrangements.
Figure 3B:
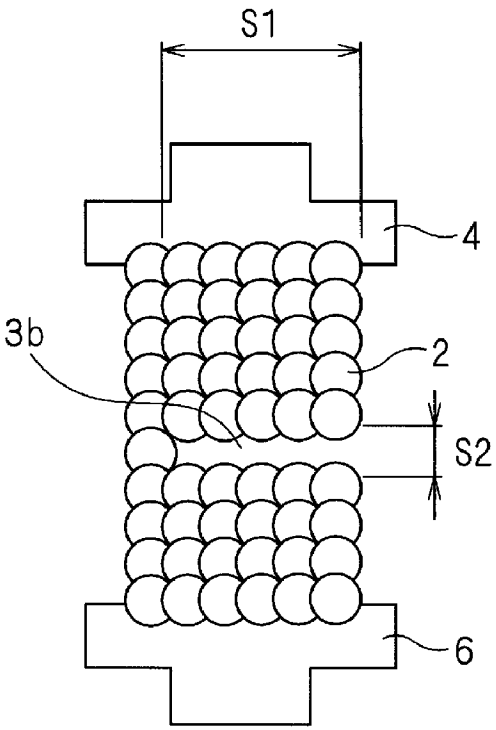
Figure 3C:
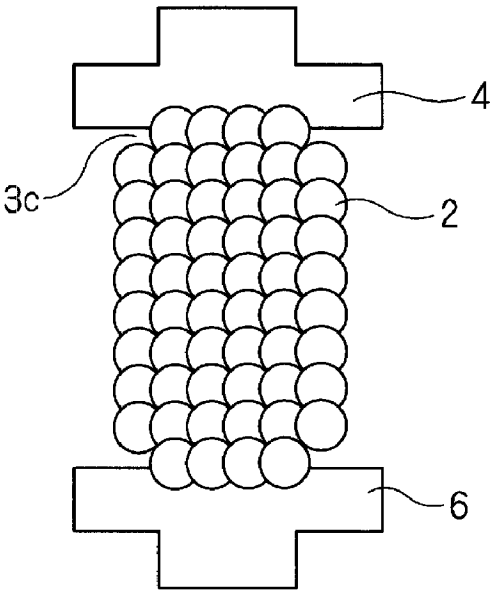

In addition, as shown in the plan views in FIGS. 3A-3C, the dots may be arranged in a grid arrangement pattern excluding a portion of the pattern.

FIG. 3A shows an example in which the dots 2 are arranged except for the center 3*a* of the arrangement pattern.

FIG. 3B shows an example in which the dots 2 are arranged except for a slit 3*b* in the arrangement pattern.

FIG. 3C shows an example in which the dots 2 are arranged except for the four corners 3*c* of the arrangement pattern.

Although a reduced number of dots are schematically shown in FIGS. 3A-3C, a larger number of dots are actually arranged. Accordingly, although in the figure one or several dots are missing from a site where no dots are arranged, a larger number of dots are actually missing.

Figure 4A:
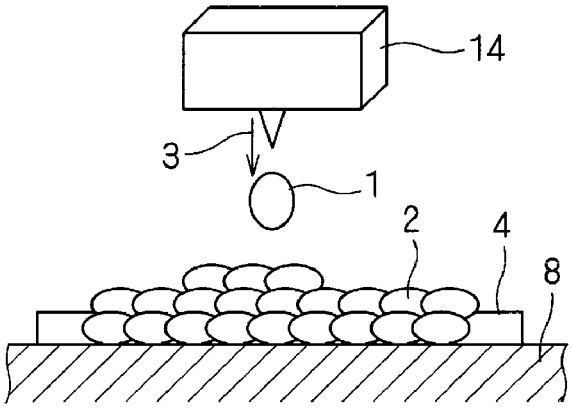
FIGS. 4A-4C are schematic diagrams showing dot arrangements.
Figure 4B:
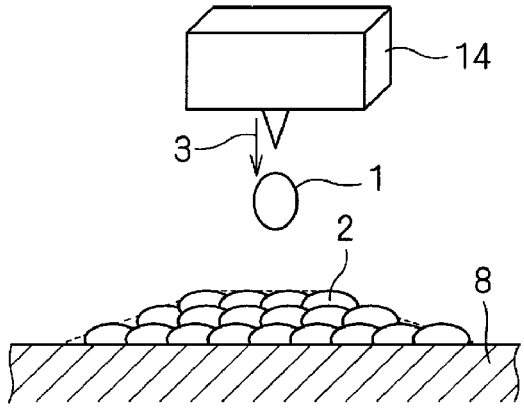

As schematically shown in the sectional views in FIGS. 4A and 4B, the dots may also be arranged in a plurality of layers.

In this case, as shown in FIG. 4A, the dots 2 may be higher than the terminal 4.

Preferably, as shown in FIG. 4B, the stacked dots 2 are gently sloped in cross section. Specifically, the dots 2 are arranged in a single layer around the edges of the region where the dots 2 are arranged and in a larger number of layers farther away from the edges, and the height of the stacked dots increases gradually with increasing distance from the edges. This alleviates a stress occurring in the substrate 8 around the edges, thus preventing a crack in the substrate 8.

Figure 4C:
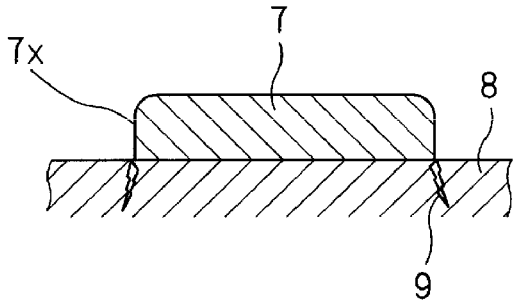

In normal screen printing, for example, as schematically shown in the sectional view in FIG. 4C, a resistive film 7 is thick up to edges 7*x*. Thus, if the resistive film 7 is thick up to the edges 7*x*, cracks 9 may occur in the substrate 8 because of the mismatch in shrinkage between the resistive film 7 and the substrate 8 when the resistive film 7 is fired. This is because a large stress difference occurs in the substrate 8 between a portion constrained by the resistive film 7 and an adjacent unconstrained portion around the edges 7*x* of the resistive film 7. A large stress difference tends to occur particularly in screen printing because the resistive film 7 is thick up to the edges 7*x*.

If the dots are arranged as in FIG. 4B, the cracks 9 can be prevented from occurring in the substrate 8 because the thickness of the resistive film decreases gradually with decreasing distance from the edges of the resistive film and accordingly the stress acting on the interface between the resistive film 7 and the substrate 8 decreases gradually.

Thus, a resistive film can be formed without changing the overall resistance of the resistive film by increasing the number of layers in the center of the resistive film so that the center is thicker.

In particular, if the dots of the first layer in contact with the substrate 8 are allowed to spread, the thickness of the resistive film around the edges thereof can be reduced, thus enhancing the effect of preventing cracks in the substrate 8. For example, the effect of preventing cracks in the substrate 8 can be enhanced using two inkjet heads, one for applying a resistive ink only for the first layer with a relatively high solvent content or a relatively small contact angle with the substrate, and the other for applying a resistive ink for the second and subsequent layers.

If the resistive ink is applied by inkjetting, the cross-sectional shape of the resistive film, and therefore the resistance thereof, can be changed by changing the intervals of the ink droplets. The resistance can also be changed by changing the amount of ink droplet (size of ink droplet), changing the number of dots in the resistive film between the terminals, or changing the number of layers. The resistance can also be changed by using one of the above methods for a portion of the resistive film, or by using two or more of the above methods in combination.

A laser trimming step, which is conventionally required for resistance adjustment in a manufacturing process, can be eliminated by measuring the resistance of a prototype and changing the resistance to a predetermined value for commercial products, thus improving productivity.

In particular, the resistance of a resistive film can be adjusted with high accuracy by adjusting through laser trimming the resistance of a resistive film formed by arranging the dots 2 in an entire reference arrangement pattern as shown in FIG. 2A, measuring the shape of the remaining resistive film after the trimming, and printing a shape resembling the measured shape of the resistive film as shown in FIG. 3A or 3B.

In addition, if the resistance of a resistive film formed by arranging the dots 2 in an entire reference arrangement pattern as shown in FIG. 2A is measured to be higher than a desired resistance, a resistance lower than that for the first time can be attained by decreasing the intervals of the droplets, for example, as shown in FIG. 2B, for the second and subsequent times. If the resistance for the first time is lower than the desired resistance, a resistance higher than that for the first time can be attained by increasing the intervals of the droplets.

As shown in FIG. 2C, for example, the desired resistance can also be attained by changing the amount (size) of ink droplet.

Next, specific examples will be described.

SPECIFIC EXAMPLE 1

A resistive ink with a solid content of 20% by weight and a viscosity of 89 mPa·s was prepared in advance by dispersing materials for resistive films of electronic components, including ruthenium oxide ($RuO_2$) and glass, in an organic solvent.

An inkjet printer including a movable table disposed below a piezoelectric inkjet head so as to be movable in the X and Y directions and a ceramic green sheet on which two separate silver electrodes, serving as a pair of terminals, were formed were prepared.

A rectangular resistive film as shown in FIG. 2A was printed on the ceramic green sheet so as to connect together the two silver electrodes by ejecting the resistive ink from the inkjet head. A dried resistive film was formed without special drying by heating the work placement table to 50° C. when printing the rectangular resistive film.

The ceramic green sheet on which the resistive film was printed was laminated on another sheet and was pressed and fired to form a ceramic substrate on which the resistive film was formed between the silver electrodes. According to resistance measurement of the resistive film on the ceramic substrate, the film was not broken.

A rectangular resistive film, as shown in FIG. 2A, with a width Wa of 1,420 μm and a length L of 2,670 μm was printed with the intervals of ink droplets of the resistive ink being 75

μm. This resistive film had a thickness of 7 μm and a resistance between the terminals 4 and 6 of 84 kΩ. This is referred to as Sample (a).

A rectangular resistive film, as shown in FIG. 2B, with a width Wb of 920 μm and a length L of 2,670 μm was printed with the intervals of ink droplets of the resistive ink in the X and Y directions changed to 50 μm by adjusting the amount of shift of the movable table and the pitch of the ink ejection holes used among the ink ejection holes of the inkjet head. This resistive film had a thickness of 18 μm and a resistance between the terminals 4 and 6 of 32 kΩ. This is referred to as Sample (b).

A rectangular resistive film, as shown in FIG. 2C, with a width Wa of 1,420 μm and a length L of 2,670 μm was printed with the intervals of ink droplets of the resistive ink being 75 μm, where only the size of amount of ink droplets of the resistive ink was changed with respect to Sample (a). This resistive film had a thickness of 10 μm and a resistance between the terminals 4 and 6 of 50 kΩ. This is referred to as Sample (c).

A rectangular resistive film as shown in FIG. 3A was printed under the same conditions as Sample (a) except that a dotless portion 3*a* with a horizontal dimension T1 of 956 μm and a vertical dimension T2 of 770 μm was formed around the center of the resistive film. This resistive film had a thickness of 7 μm and a resistance between the terminals 4 and 6 of 95 kΩ. This is referred to as Sample (d).

Samples (a) to (d) above are summarized in Table 1 below.

TABLE 1

| Sample | (a) | (b) | (c) | (d) |
|---|---|---|---|---|
| Dot diameter | 107 μm | 107 μm | 130 μm | 107 μm |
| Dot intervals (pitch) | 75 μm | 50 μm | 75 μm | 75 μm |
| Thickness of resistive film | 7 μm | 18 μm | 10 μm | 7 μm |
| Resistance | 84 kΩ | 32 kΩ | 50 kΩ | 95 kΩ |

Samples as above are prepared as needed to ascertain in advance how much the resistance is changed by decreasing the dot intervals or increasing the dot diameter. That is, once a calibration curve of resistance versus dot intervals or dot diameter is determined, the dot intervals or dot diameter can be determined according to the calibration curve so as to attain a desired resistance. For example, if the resistance of a prototyped electronic component is higher than a desired resistance, it can be adjusted to the desired resistance by increasing the dot intervals or dot diameter according to the calibration curve. By this method, the resistance can be either increased or decreased.

SPECIFIC EXAMPLE 2

The resistance of the resistive film of Sample (a) prepared in Specific Example 1 was adjusted to 98 kΩ by laser trimming. Based on data acquired by image recognition and digitalization of the shape of the resistive film subjected to laser trimming using a CCD camera, ink ejection positions were determined so that no dots 2 were provided in a region with a horizontal dimension S1 of 545 μm and a vertical dimension S2 of 206 μm, thus forming a slit 3*b*, as shown in FIG. 3B, in a rectangular resistive film. The other printing conditions were the same as those of Sample (a). The resistance of the sample with the slit 3*b* was measured to be 95 kΩ, which is substantially the same as the resistance of Sample (a) after the trimming, namely, 98 kΩ.

CONCLUSION

If a resistive film is formed by inkjetting as described above, a resistive film with a desired resistance can be formed by changing the amount (size) of ink droplet of a resistive ink, the number of dots in the vertical direction and/or the horizontal direction, and the number of layers. Thus, electronic components including resistive elements with various resistances can be efficiently produced.

As compared with the case where printing is performed a plurality of times while switching resistive pastes for different resistances, inkjet printing with a resistive ink provides (a) improved productivity due to a reduced print time, (b) improved productivity due to a reduced number of times of drying, (c) improved shape accuracy after printing due to reduced work deformation, and (d) reduced resistance variations.

The present invention is not limited to the above preferred embodiments but can be implemented with various modifications.

For example, the reference pattern for dot arrangement is not limited to the rectangular grid pattern shown as an example but can be any pattern.

While preferred embodiments of the present invention have been described above, it is to be understood that variations and modifications will be apparent to those skilled in the art without departing the scope and spirit of the present invention. The scope of the present invention, therefore, is to be determined solely by the following claims.

What is claimed is:

1. An electronic component comprising:

a pair of terminals opposite each other; and a resistive element disposed between the pair of terminals; wherein the resistive element consists of a plurality of dots arranged so as to overlap each other in a reference arrangement pattern excluding a portion of the reference arrangement pattern.

2. The electronic component according to claim 1, wherein the resistive element includes a plurality of layers of the plurality of dots, the number of the plurality of layers of the plurality of dots being larger in a region farther away from edges of the resistive element.

3. A method for producing an electronic component, comprising:

a first step of prototyping an electronic component including a resistive element by arranging dots of a resistive ink containing a constituent that is to be the resistive element in an entire reference arrangement pattern by inkjetting;

a second step of partially removing the resistive element of the prototyped electronic component while measuring the resistance of the resistive element;

a third step of determining a portion to be excluded from the reference arrangement pattern based on a shape of the partially removed resistive element; and a fourth step of manufacturing electronic components by arranging all of the dots of the resistive ink in the arrangement pattern excluding the determined portion.

4. A method for producing an electronic component, comprising:

a first step of prototyping an electronic component including a resistive element by arranging dots of a resistive ink containing a constituent that is to be the resistive element in an entire reference arrangement pattern by inkjetting;

a second step of measuring resistance of the resistive element of the prototyped electronic component;

a third step of determining intervals of the dots to be arranged in the reference arrangement pattern based on the measured resistance of the resistive element; and a fourth step of manufacturing electronic components by arranging all of the dots of the resistive ink at the determined intervals in the entire reference arrangement pattern.

5. A method for producing an electronic component, comprising:

a first step of prototyping an electronic component including a resistive element by arranging dots of a resistive ink containing a constituent that is to be the resistive element in an entire reference arrangement pattern by inkjetting;

a second step of measuring resistance of the resistive element of the prototyped electronic component;

a third step of determining a size of the dots of the resistive ink on the basis of the measured resistance of the resistive element; and a fourth step of manufacturing electronic components by arranging all of the dots of the resistive ink with the determined size of the dots in the entire reference arrangement pattern.

* * * * *